United States Patent [19]

Alston

[11] Patent Number: 4,905,991

[45] Date of Patent: Mar. 6, 1990

[54] SWIM WEIGHTS

[76] Inventor: Gregory A. Alston, 917 Tabb Lakes Dr., Tabb, Va. 23602

[21] Appl. No.: 245,380

[22] Filed: Sep. 16, 1988

Related U.S. Application Data

[63] Continuation-in-part of Ser. No. 215,508, Jul. 6, 1988, abandoned.

[51] Int. Cl.[4] ..... A63B 21/00; A63B 31/00

[52] U.S. Cl. ..... 272/119; 272/71; 441/59

[58] Field of Search ..... 272/1 B, 71, 93, 116, 272/119, 130, 117; 441/59, 60; 434/254

[56] References Cited

U.S. PATENT DOCUMENTS

| | | | |
|---|---|---|---|
| 516,963 | 3/1894 | Bunsen . | |
| 2,241,833 | 5/1941 | Waller | 272/119 |
| 2,692,995 | 11/1954 | Le Bihan | 441/59 X |
| 3,107,371 | 10/1963 | Thompson . | |
| 3,835,493 | 9/1974 | Grivna | 441/59 X |
| 3,924,851 | 12/1975 | Winston | 272/119 X |
| 4,239,211 | 12/1980 | Wilkerson | 272/119 |
| 4,258,914 | 3/1981 | Lalli | 272/71 |
| 4,300,750 | 11/1981 | Caplan | 272/116 |
| 4,330,120 | 5/1982 | Netti | 272/119 |
| 4,384,714 | 5/1983 | Kimura | 272/119 |
| 4,396,190 | 8/1983 | Wilkerson | 272/119 |
| 4,484,740 | 11/1984 | Green | 272/119 |
| 4,585,228 | 4/1986 | Olson | 272/119 |
| 4,602,784 | 7/1986 | Budden et al. | 272/119 |
| 4,621,808 | 11/1986 | Orchard et al. | 272/119 |
| 4,623,143 | 11/1986 | Wuellenweber | 272/119 |
| 4,684,122 | 8/1987 | Desmond et al. | 272/119 |
| 4,804,326 | 2/1989 | Lennon | 272/71 X |

FOREIGN PATENT DOCUMENTS

| | | | |
|---|---|---|---|
| WO83/01201 | 4/1983 | World Int. Prop. Ó. | 272/119 |

*Primary Examiner*—V. Millin
*Assistant Examiner*—Robert W. Bahr
*Attorney, Agent, or Firm*—Wallace J. Nelson

[57] ABSTRACT

A swim weight sleeve system for use in aquatic exercises and training applications by swimmers is disclosed. Sleeve (1) includes a rubberized sleeve material (2) containing an adjustable quantity of weights (3) and adapted to snugly fit around the forearms and/or calves of a swimmer. Sleeve (1) is adapted to stretch over the hand or foot of a swimmer and retract to substantially its original size to provide a snug fit conforming to the shape of the forearm or calf of the swimmer. Securing straps (5), provided at each end of sleeve (1), ensure a secure fit of the sleeves. A wrap-around weighted sleeve (6) and a non-weighted sleeve (10) that absorbs water to serve as weight during swimming are also disclosed.

4 Claims, 3 Drawing Sheets

SWIM WEIGHTS

RELATED APPLICATION

This application is a continuation-in-part of application Ser. No. 215,508 filed July 6, 1988 for STROKE AND KICK WEIGHTS (which is abandoned upon filing of this application).

FIELD OF THE INVENTION

This invention relates generally to exercise devices and relates in particular to weighted acquatic training devices for swimmers. Although a singular invention, when swim weights are worn on the arm they are referred to as stroke weights; when swim weights are worn on the leg they are referred to as kick weights.

BACKGROUND OF THE INVENTION

Acquatic training and physical conditioning devices are quite limited in scope and variety. Currently, the typical training devices for swimmers, while remaining in the water, are hand paddles and drag suits. Hand paddles simply cause drag against the swimmer's arm muscles that push and pull through the water, but do nothing for the muscles that are required to lift the arm and reach for the next stroke. Also, with hand paddles, stroke technique is sacrificed due to the altered hand entry into the water when wearing such devices. Drag suits cause a similar result on the pushing and pulling muscles as well as kicking muscles of a swimmer due to increased drag along the swimmer's body; the drag causes the swimmer to kick and pull harder in order to move through the water. However, these devices again do nothing for the lifting and reaching muscles associated with swimming. Currently, if weight training for the swimmer is desired, the swimmer must exit the water and use weight training equipment in a dry area, thus losing valuable "in-water" time. A weight training device that allows a swimmer to condition all associated stroking and kicking muscles while preserving precious "in-water" time, and not sacrificing stroke technique, would be highly welcomed by swim coaches and offer a great advantage to the competitive swimmer. There is thus, a need in the art for swim weights for more effective swimming training and conditioning.

SUMMARY OF THE INVENTION

Accordingly, it is an object of the present invention to provide weighted acquatic training devices for use on the limbs of swimmers.

It is another object of the present invention to provide a durable, weighted sleeve for use over the limbs of swimmers for the purpose of physical conditioning.

Another object of the present invention is to provide a weighted sleeve to fit snugly on the limbs of swimmers.

A further object of the present invention is to provide a weighted sleeve to conform to the surface contours of a swimmer's limbs to allow water to flow near naturally over the surface.

An additional object of the present invention is to provide weighted acquatic training devices to condition all associated stroking and kicking muscles of swimmers, to include those muscles required to lift and reach for the next stroke;

Another object of the present invention is to provide weight training and conditioning for swimmers while they remain in the water.

It is also an object of the present invention to provide weight training and conditioning for swimmers without sacrificing proper stroke and kick techniques.

According to one aspect of the present invention the foregoing and additional objects are attained by providing a rubberized (or other stretchy material) sleeve having units of weight (lead or other suitabel weighted material). The sleeve must be able to stretch overr an extremity of a swimmer to fit snugly on the desired limb. The stretchy material of the said sleevev conforms to the contours of the selected limb to allow a near natural flow of water across and around the surface. The proposed weight or weights are thin shapes, molded or packaged, that are spaced along or inside the sleeve material to allow the stretching feature between each unit of weight if more than one weight is used. A securing strap may be employed at one or both ends of the sleeve to fasten tightly so as to prevent the sleeve from slipping during rigorous swimming motions. Due to the disparity of age groups and body sizes of swimmers, there may be a requirement for a variety of sleeve sizes and weights.

Considering another aspect of the present invention the foregoing and additional objects are attained by providing a weighted sleeve that wraps around a limb of a swimmer and fastens to a snug fit. Fastening straps are employed to insure a secure enough fit to allow vigorous swimming movements.

In yet a third aspect of the present invention the foregoing and additional objects are attained by providing a sleeve that is unweighted when dry, but will capture water to use as weight from the body of water surrounding the swimmer. The sleeve is formed of a porous material and contains an absorbent material that will hold adequate water to offer weight training to the user when the sleeved limb is lifted for a stroke from the mainn body of water. When the limb wearing the sleeve re-enters the water, any water drained from the sleeve during the previous stroke is re-absorbed to use as weight for the next stroke.

BRIEF DESCRPTION OF THE DRAWINGS

A more complete appreciation of the invention and many of the attendant advantages thereof will be readily appreciated as the same becomes better understood by reference to the following detailed description when considered in connection with the accompanying drawings, wherein.

Figure 2:
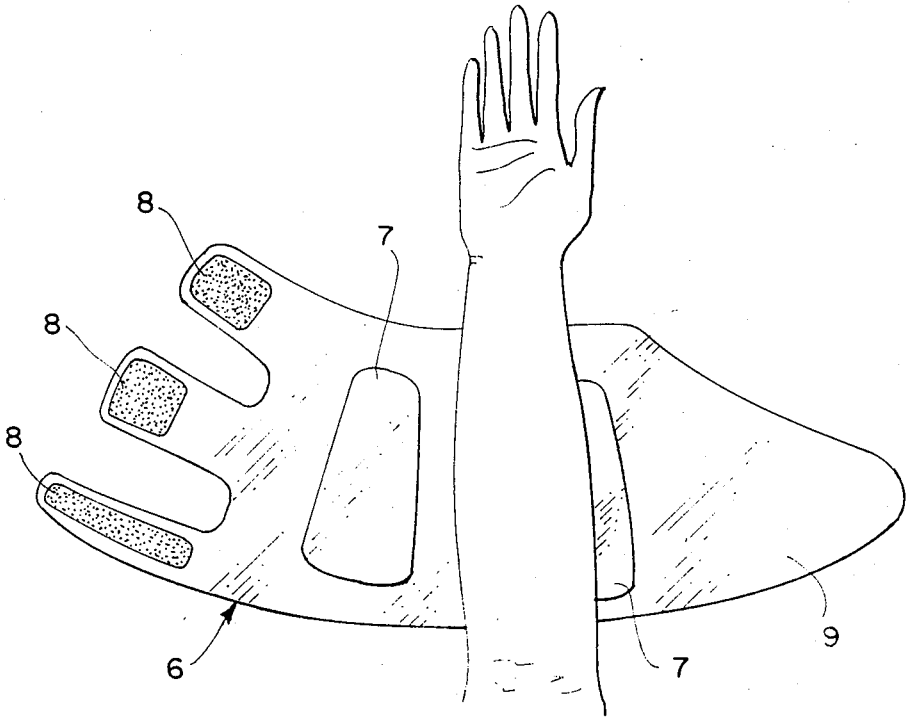
FIG. 2 is a perspective top view of another sleeve embodiment of the present invention in preparation for donning.
Figure 2A:
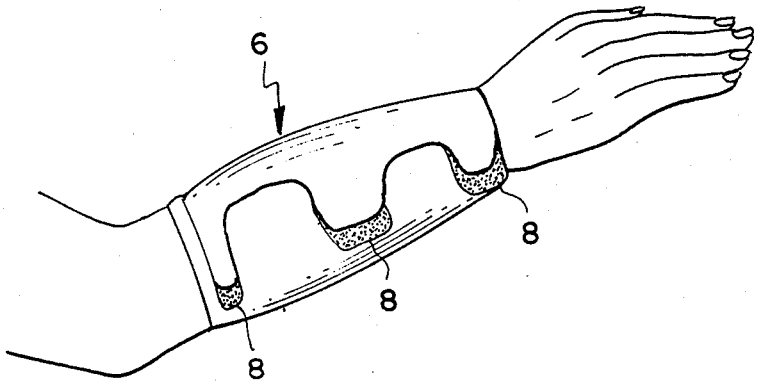
Figure 3:
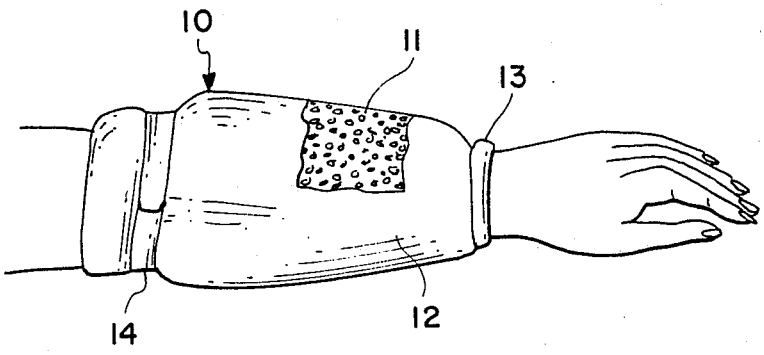
Figure 4:
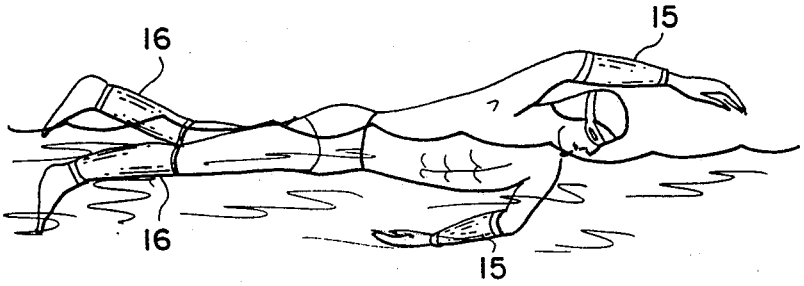

FIG. 2*a* is an illustration of the sleeve embodiment described in FIG. 2 after donning procedure is completed;

FIG. 3 is a perspective side view of a third sleeve embodiment of the present invention, with parts broken away;

FIG. 4 is a depiction of the present invention in use in the water as both stroke weight sleeve and kick weight sleeve embodiments.

DESCRIPTION OF THE PREFERRED EMBODIMENTS

Figure 1:
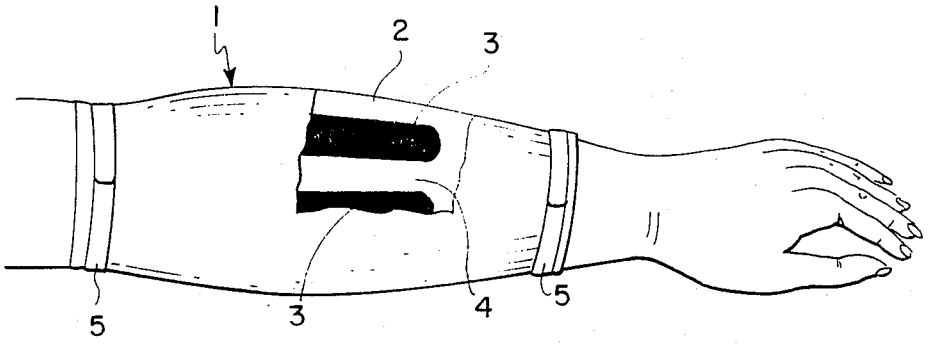
FIG. 1 is a perspective side view of the preferred sleeve embodiment of the present invention, with parts broken away.

Referring now to the drawings and more particularly to FIG. 1, the preferred embodiment of the present invention is shown and designated generally by reference numeral 1. Sleeve 1 includes a sleek, pliablel water adaptable material 2. A suitable material is 1/8 inch, closed cell neoprene rubber incorporating stretchy, nylon fabric bonded to one or both sides, available as catalog number N101-19 offered by the McNett Company of Seattle, Wash. The material 2 houses units of weight 3 that are fixed to the sleeve 1. An example of a suitable weighted material would be lead; packaged lead shot or molded lead designed into usable shapes to be incorporated onto or into the sleeve 1 or the like. The units of weights are contained in thin pouches made of nylon, or other material suitable for use in water, and sewn or glued onto the material 2. The units of weight 3 may also be housed in envelopes or pouches that are pre-fabricated into the sleeve 1 material 2. While it is prefered that at least one pound of weight is fixed permantly onto sleeve 1, the pouch housing of the weights offers the option to add or remove additional units of weight 3. The preferred accumulated total weight value of units of weight 3 provides options of one, two, or three pounds of weight, but may vary depending on physical training objectives of the individual swimmer. Pliable material 2 provides elasticity and resilience so as to stretch over the swimmer's extremity and retract for a snug fit on the swimmer's selected limb. When more than onen unit of weight is used, the units of weight 3 are spaced, as indicated by reference number 4, for weight distribution. Also, the spacing 4 between units of weight 3 allows the material 2 of the sleeve 1 to expand and retract for donning purposes. Optional securing straps 5 provide the ability to secure sleeve 1 snugly onto the user's limb and utilize strong adjustable fastening devices, such as the fabric hook and loop or Velcro method, to prevent slippage the sleeve.

Referring now more particularly to FIG. 2, another sleeve embodiment according to the present invention is shown and designated generally by reference numeral 6. The wrap around sleeve 6 is provided with a material conducive to use in water. A suitable material is 1/16 inch 40 grade neoprene rubber offered by the Hampton Rubber Company in Hampton, Va. Also suitable is 1/8 inch closed cell neoprene rubber with a stretchy nylon fabric bonded to one or both sides as previously described. The sleeve 6 utilizes one or moreo units of weight 7 such as those found in sleeve 1, FIG. 1. Fastening devices 8 secure the sleeve 6 after wrapping said sleeve around the user's limb. A suitable fastening device is the Velcro hook and loop method. The sleeve 6 is designed to spread open as shown in FIG. 2 to facilitate easy donning onto selected limb. A flap 9 is featured to assist self-donning by the user. The wrap around precedure of the sleeve 6 begins when the flap 9 is folded around the user's limb and tucked between the limb and sleeve material. The fastening end 8 of sleeve 6 is then wrapped snugly over the flap 9 and secured to opposite end fasteners located on the outside of the sleeve 6. Referring to FIG. 2*a*, a depiction is shown of the appearance of the sleeve shown in FIG. 2 after the wrap-around procedure is completed.

Referring now more particularly to FIG. 3, another sleeve embodiment is shown and designated generally by reference numeral 10. The sleeve 10 is non-weighted when dry, and contains water absorbent material 11 such as polyester quilting produced by the Fairfield Processing Corporation, Danbury, Conn. 06810. A foamed rubber, such as urethane rubber offered by the Hampton Rubber Company of Hampton, Va., is also a suitable material to absorb and hold water. As the sleeve 10 is positioned on a swimmer's limb and passes through the body of water surrounding the swimmer, the absorbent material 11 captures water to serrve as weight. When the swimmer's limb is lifted from the main body of water to reach for another stroke, enough absorbed water remains in the sleeve 10 to offer the desired weight training effect to the swimmer. The sleeve 10 will re-absorb any water lost due to gravity drainage when the limb wearing the sleeve re-enters the main body of water to complete the swimming stroke. The outer covering 12 of sleeve 10 is formed of a suitable porous material to permit passage of water to the primary absorbing material 11. Covering 12 may also be formed of the same material as adsorbent material 11 if so desired. An elasticized band 13 is featured at one end of the sleeve 10, and a securing strap 14 is featured at the opposite end to prevent the sleeve 10 from slipping during rigorous swimming actions. The securing strap 14 is preferably made of nylon web. Other durable materials that are usuable in water, and have a sturdy fastening device as described on the aforrementioned embodiments, may also be employed for strap 14.

Referring now to FIG. 4, swim weights in any embodiment (as defined in FIGS. 1, 2 and 3, reference numerals 1, 6 and 10) are shown in use for swimming conditioning. FIGS. 1, 2, and 3 depicted swim weights more particularly adapted to the user's upper limbs, while they may, in each case, be easily adapted in any of the prior defined embodiments for use on the lower limbs as shown in FIG. 4, reference numeral 16. When worn on the arms, the selected sleeves are referred to as stroke weight sleeves 15; when adapted for use on the legs, they are referred to as kick weight sleeves 16. The snug fit and thin profile of the sleeves 15 and 16, are designed to provide a contoured fit over the user's limbs to allow proper swimming technique and near natural water flow across and around the surface of each sleeve.

It is thus seen that each sleeve of the present invention provides a novel weighted acquatic training device for swimmers. Swim weights, both stroke weight sleeves and kick weight sleeves, described and illustrated herein may be readily handled and used by swimmers with relative ease.

Although specific materials have been described for constructing the sleeve employed in each of the embodiments, it is to be understood that these examples are exemplary only and are not exhaustive. Thus, the weighted sleeves described may be formed of any suitable materials that are durable, meet the intended objects, and arre useable in water, within the scope of the invention.

Modifications and variations of the present invention that will be readily apparent to those skilled in the art in the light of the above teachings are considered to be incorporated herein. It is therefore to be understood that the invention may be practiced other than as specifically described without departing from the spirit and scope of the appended claims, such as wearing the weighted sleeves on the upper arms and legs as opposed to or in addition to the lower arms and legs.

What is claimed as new and desired to be secured by Letters Patent of the United States is:

1. A weighted training device for use on a swimmer's forearms or lower legs comprising:

a thin, generally cylindrical sleeve for encircling a limb of a swimmer, said sleeve having a resilient, smooth outer surface for allowing said sleeve to stretch over the swimmer's hand or foot and to retract for a snug fit on the swimmer's limb, and for allowing unobstructed flow of water araound said sleeve;

an elastic band on a first end of said sleeve for providing a watertight seal between the swimmer's limb and said sleeve;

a retaining means on a second end of said sleeve for securing the second end of said sleeve to the swimmer's limb; and a plurality of weights within said sleeve for providing a desired amount of weight resistance.

2. The weighted training device of claim 1 wherein said sleeve is constructed of a closed cell neoprene rubber having nylon fabric bonded on at least one surface thereof.

3. The weighted training device of claim 1 wherein said plurality of weights comprise a plurality of individual weight units disposed in spaced relationship about the circumference of said sleeve.

4. The weighted training device of claim 1 wherein said sleeve is constructed of a substantially flat sheet of material adapted to be wrapped around a length of the swimmer's limb and a hook and loop type fabric connecting element disposed on adjacent areas of the wrapped flat sheet material to secure the wrapped material in the form of a sleeve on the swimmer.

* * * * *